US007539571B2

(12) United States Patent
Strosser et al.

(10) Patent No.: US 7,539,571 B2
(45) Date of Patent: May 26, 2009

(54) NON-CONTACT NEUTRAL SENSING WITH DIRECTIONAL FEEDBACK

(75) Inventors: Richard P. Strosser, Akron, PA (US); Zachary Scmook, Lititz, PA (US); Douglas R. Otto, New Holland, PA (US); David G. Lutz, New Holland, PA (US)

(73) Assignee: CNH America LLC, New Holland, PA (US)

( * ) Notice: Subject to any disclaimer, the term of this patent is extended or adjusted under 35 U.S.C. 154(b) by 0 days.

(21) Appl. No.: 11/446,882

(22) Filed: Jun. 5, 2006

(65) Prior Publication Data

US 2007/0282507 A1 Dec. 6, 2007

(51) Int. Cl.
*B60K 17/00* (2006.01)
*G06F 19/00* (2006.01)

(52) U.S. Cl. ..... 701/50; 701/102; 701/113; 307/9.1; 307/10.1; 307/10.3; 307/10.4; 307/10.5; 307/10.6; 56/10.5; 56/10.8; 477/99

(58) Field of Classification Search ..... 701/1, 701/50, 102, 113; 307/9.1, 10.1, 10.3–10.6; 56/10.5, 10.8; 477/99
See application file for complete search history.

(56) References Cited

U.S. PATENT DOCUMENTS 4,542,721 A * 9/1985 Williams ..... 477/99
5,252,861 A * 10/1993 Steeby et al. ..... 307/10.6
5,514,048 A * 5/1996 Jacobson et al. ..... 477/99
5,586,955 A 12/1996 Wanie
5,649,606 A * 7/1997 Bebernes et al. ..... 180/307
5,809,441 A 9/1998 McKee
6,021,368 A 2/2000 Taniguchi et al.
6,027,426 A * 2/2000 Holman ..... 477/99
6,633,805 B2 * 10/2003 Burgart et al. ..... 701/51
6,935,106 B2 8/2005 Korthals
6,935,204 B2 8/2005 Walker et al.
2002/0056334 A1 5/2002 Fujinuma
2003/0213327 A1 11/2003 Syamoto
2004/0031344 A1 2/2004 Babin et al.
2004/0035237 A1 2/2004 Matsui et al.
2004/0186646 A1 9/2004 Kuwata et al.
2005/0028624 A1 2/2005 Murakami et al.
2005/0044850 A1 * 3/2005 Korthals ..... 60/487
2005/0113207 A1 5/2005 Wang
2005/0121279 A1 6/2005 Nakane et al.
2005/0126322 A1 6/2005 Kozaki et al.
2006/0089772 A1 4/2006 Otto et al.

* cited by examiner

*Primary Examiner*—Jack W. Keith
*Assistant Examiner*—Chuong P Nguyen
(74) *Attorney, Agent, or Firm*—Patrick M. Sheldrake; John William Stader; Michael C. Harms

(57) ABSTRACT

A non-contact neutral sensing apparatus with directional feedback in a vehicle directional control system for an agricultural or construction vehicle.

10 Claims, 5 Drawing Sheets

NON-CONTACT NEUTRAL SENSING WITH DIRECTIONAL FEEDBACK

BACKGROUND OF THE INVENTION

The present invention relates generally to hydrostatically driven vehicles, and more particularly to a neutral start interlock that utilizes non-contacting sensors to monitor the position of the hydrostatic displacement control on such systems used in agricultural and construction.

Agricultural and construction vehicles propelled by engines driving one or more hydraulic pumps, wherein vehicle speed and direction are controlled by the hydraulic pumps are well known. Many such vehicles are propelled by two hydraulic pumps, one for each of a pair of front driving wheels. Direction of travel is controlled by adjusting the relative speeds of the two drive wheels.

Such hydrostatic drive systems are often configured with the hydraulic pump attached directly to the engine without a clutch or other mechanisms to stop rotation of the pump while the engine is running. The vehicle is then subject to movement based on the pump displacement control which most commonly is moved selectively through forward-neutral-reverse positions by the operator.

It is known to provide a neutral start feature on vehicles having hydrostatic drive systems. Neutral start mechanisms are designed to prevent the vehicle engine from being started while the transmission is in a driving, non-neutral mode, and thereby generally prevent the vehicle from lunging forward or turning when started. Conventional neutral start mechanisms tend to add complexity to the overall linkage structure and contribute to a relatively high overall part count for the linkage structure, thus adding to manufacturing and maintenance costs.

Conventional neutral start systems rely on position sensing mechanisms that are typically costly to manufacture and assemble, space consuming, and complex. Conventional position sensing mechanisms typically utilize mechanical connections between transmission control arms and the sensing device which require periodic adjustment and regular maintenance. Such mechanical interconnections may lack the necessary reliability for agricultural applications wherein equipment down time, especially during critical harvest times, jeopardizes the crop and represents a significant economic disadvantage.

It would be a great advantage to provide a neutral start system that replaces the usual mechanical connection mechanism with a non-contacting sensor apparatus to provide a signal to the neutral start system indicating that the vehicle drive pumps are in neutral or indicate the direction the pump controls must be moved to reach neutral thereby overcoming the above problems and disadvantages.

SUMMARY OF THE INVENTION

Accordingly, it is an object of the present invention to provide a non-contacting neutral sensor for use in agricultural and construction vehicle neutral start systems.

It is a further object of the present invention to replace mechanical linkages and potentiometers used in conventional neutral sensing mechanisms with a less complex, non-contact sensor to avoid vehicle vibration-induced failures.

It is a further object of the present invention to provide a neutral position sensing apparatus with a directional feedback feature capable of directing the action required of a vehicle operator in order to satisfy a vehicle starting interlock thereby allowing the vehicle engine to be started.

It is a further object of the present invention to provide a neutral position sensing apparatus for a vehicle that uses existing components in the vehicle drive and directional control system, with minor modifications, instead of adding new components, thereby reducing the complexity of the neutral start position sensing apparatus.

It is a still further object of the present invention to provide a neutral position sensing apparatus having improved reliability, thereby avoiding costly downtime for adjustment, maintenance, or repair.

It is a still further object of the present invention to provide a neutral sensing apparatus that is durable in construction, inexpensive of manufacture, carefree of maintenance, easily assembled, and simple and effective to use.

These and other objects are achieved by providing a non-contact neutral sensing with directional feedback for an agricultural or construction vehicle.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "left" or "right," "up" or "down," or "top" or "bottom" are used as a matter of mere convenience, and are determined by standing at the rear of the machine facing in its normal direction of travel. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail.

Figure 1:
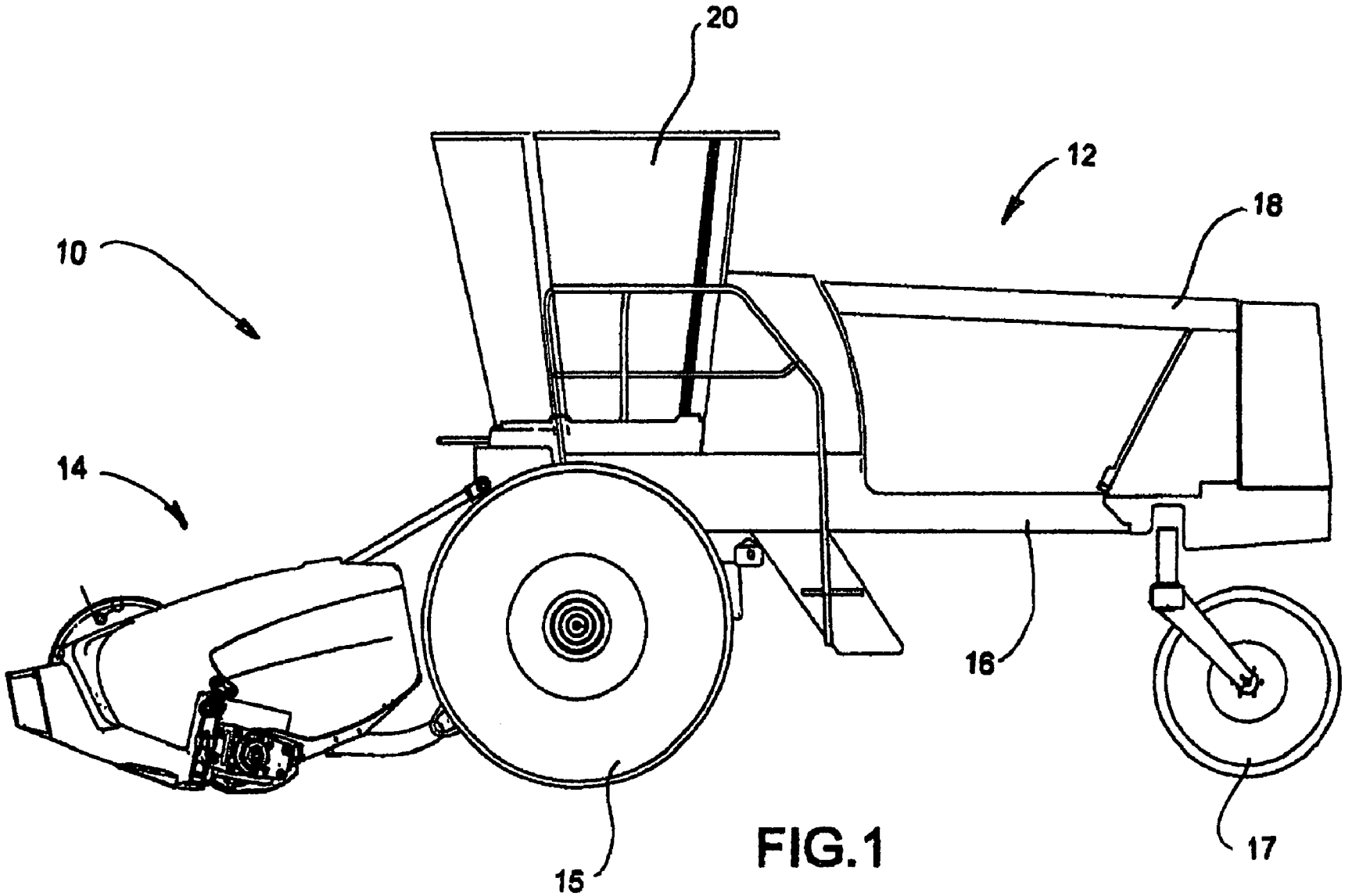
FIG. 1 is a side view of a self-propelled windrower of the type which the instant invention will prove advantageous.

FIG. 1 shows a typical and generally well known self-propelled agricultural windrower 10, of the type commonly relying on hydraulic drive systems. Primary components of the windrower include a tractor 12 and a header 14. Tractor 12 has a main frame 16, that is supported by a pair of drive wheels 15 (only one shown) and a pair of rear wheels 17 adjacent to the rear end. An engine, located under cowling 18, a transmission and other components, as will be discussed further below and generally well known in the art, are likewise supported on main frame 16 and provide the power necessary for the machine to operate. A cab 20 encloses an operator's platform to provide an environmentally controlled location from which the windrower can be comfortably operated. While an agricultural windrower is shown in FIG. 1, the present invention is well suited for application in many agricultural and construction vehicles that rely on differential steering for directional control.

Header 14 may be of several designs, but typically comprises a cutting mechanism, either a sicklebar or rotary cutter, a feeder mechanism and conditioning rolls. The header is supported by a hydraulic lift and flotation structure that may be activated to selectively raise or lower the header between transport and operational positions.

The general mode of operation of a modern self-propelled windrower is to have tandem hydrostatic pumps, one for each of two front drive wheels, each pump having a depending pintle arm such that forward and reverse movement of the pintle arm relative to a neutral position causes the associated hydrostatic pump, and thus the associated drive wheel motor and wheel, to rotate. During the original assembly of the windrower and during normal maintenance and repair operations in the life of the machine, the pintle arms must be adjusted to neutral.

Figure 2:
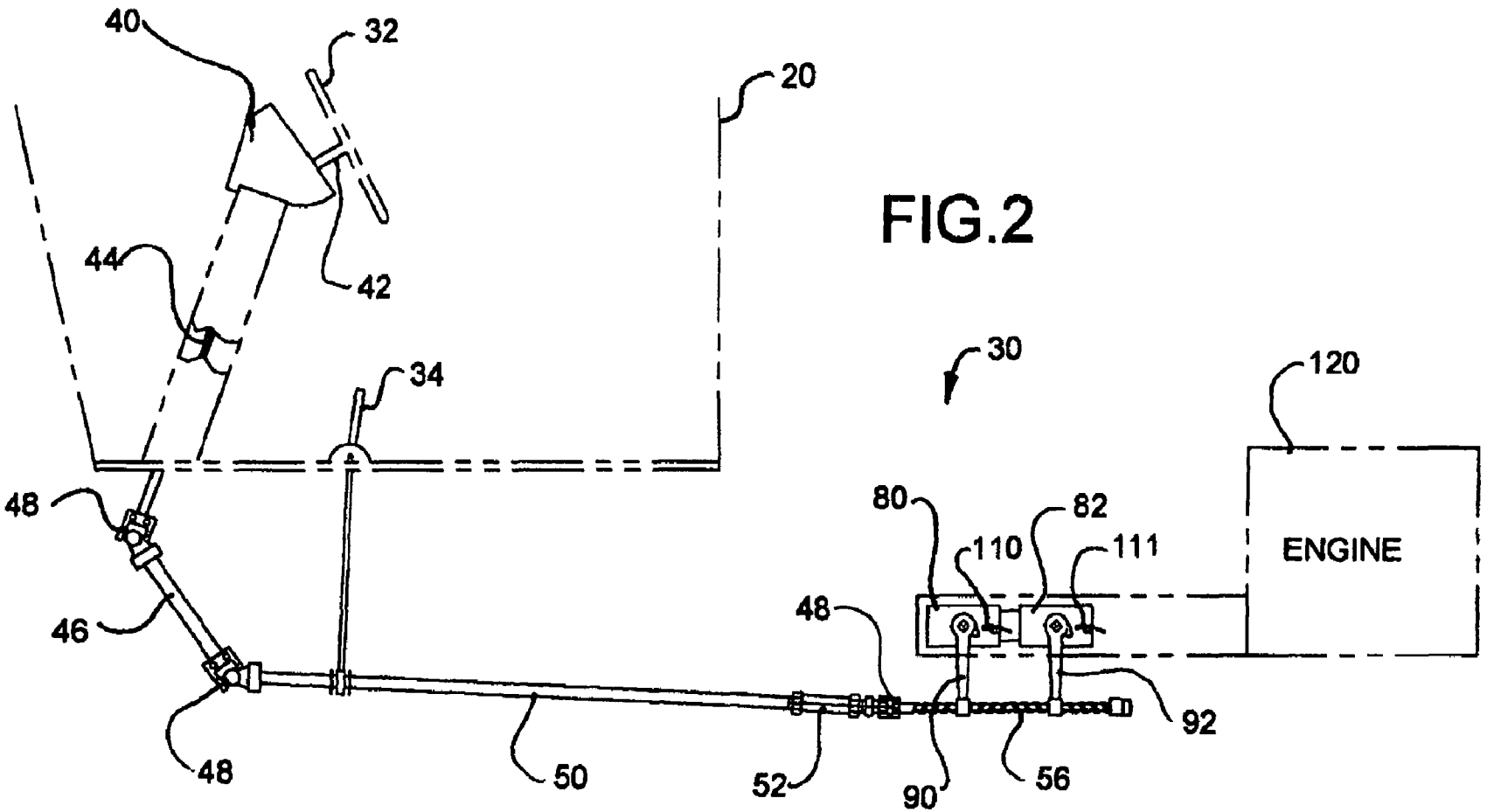
FIG. 2 is a partial side view of an operator's cab and directional control system from a self-propelled windrower, similar to that shown in FIG. 1, of the type which the instant invention will prove advantageous.

Referring to FIG. 2, a side view of cab 20 is partially depicted in phantom. A portion of the vehicle motion transfer mechanism 30 is shown to include a conventional steering wheel 32, forward-neutral-reverse lever 34 and console 40 inside the cab. The cab would, of course, include additional components (not shown) such as a seat, electrical and mechanical controls for operation of the vehicle, and the like. The steering wheel is attached to a stub shaft 42 that is connected to the upper end of front shaft 44 by a universal connector (not shown). The universal connector is well known in the art as a mechanism to transmit rotational movement between two shafts that are not necessarily in axial alignment. The stub and front shafts are supported in the console by bearings (not shown) to limit motion of the shafts to one axis, that is rotation about the longitudinal shaft axis. Bearings and bearing supports are also well known in the art and are not described in further detail. The lower end of front shaft 44 is connected to elongate control shaft 50 by another universal connector 48, and power-take-off shaft, 46. A length adjustment assembly 52 is attached to the rearmost end of control shaft 50.

Length adjustment assembly 52 is connected, by another universal connector 48, to elongate threaded rod-like member 56 one end with right-hand threads and the other with left-hand threads. Steering wheel 32 is selectively rotatable in opposing directions and results in generally proportional rotation of member 56. Two tandem hydraulic pumps 80, 82 are located above member 56 and each has a pintle arm 90, 92, respectively, depending therefrom that rotates about a pivot point, 91, 93. Each pintle arm has an internally threaded block threaded onto member 56, such that rotation of member 56 causes the end of pintle arm to move either forwardly or rearwardly, depending upon the direction of rotation of the rod-like member. Thus, rotation of member 56 results in one pintle arm rotating in a clockwise direction and the other rotating in a counter-clockwise direction, when viewed from the side, as in FIG. 2. This causes one pump to increase flow and the other to decrease flow relative to one another, turning the windrower. Sensors 110,111 are shown proximate to pintle arms 90, 92 as required to sense the rotational position of the pintle arms. Engine 120 supplies power to the hydraulic pumps.

Within cab 20 is a forward-neutral-reverse lever 34. This is continuously and selectively movable by the operator to allow a change in speed and directions (forward or reverse). The neutral position has either an indent or other mechanism to allow easy recognition by the operator. Lever 34 is connected to and intended to selectively move control member 56 forwardly or rearwardly to simultaneously move both pintle arms an equal amount, thus allowing an equal increase or decrease in flow from the hydraulic pumps.

Figure 3:
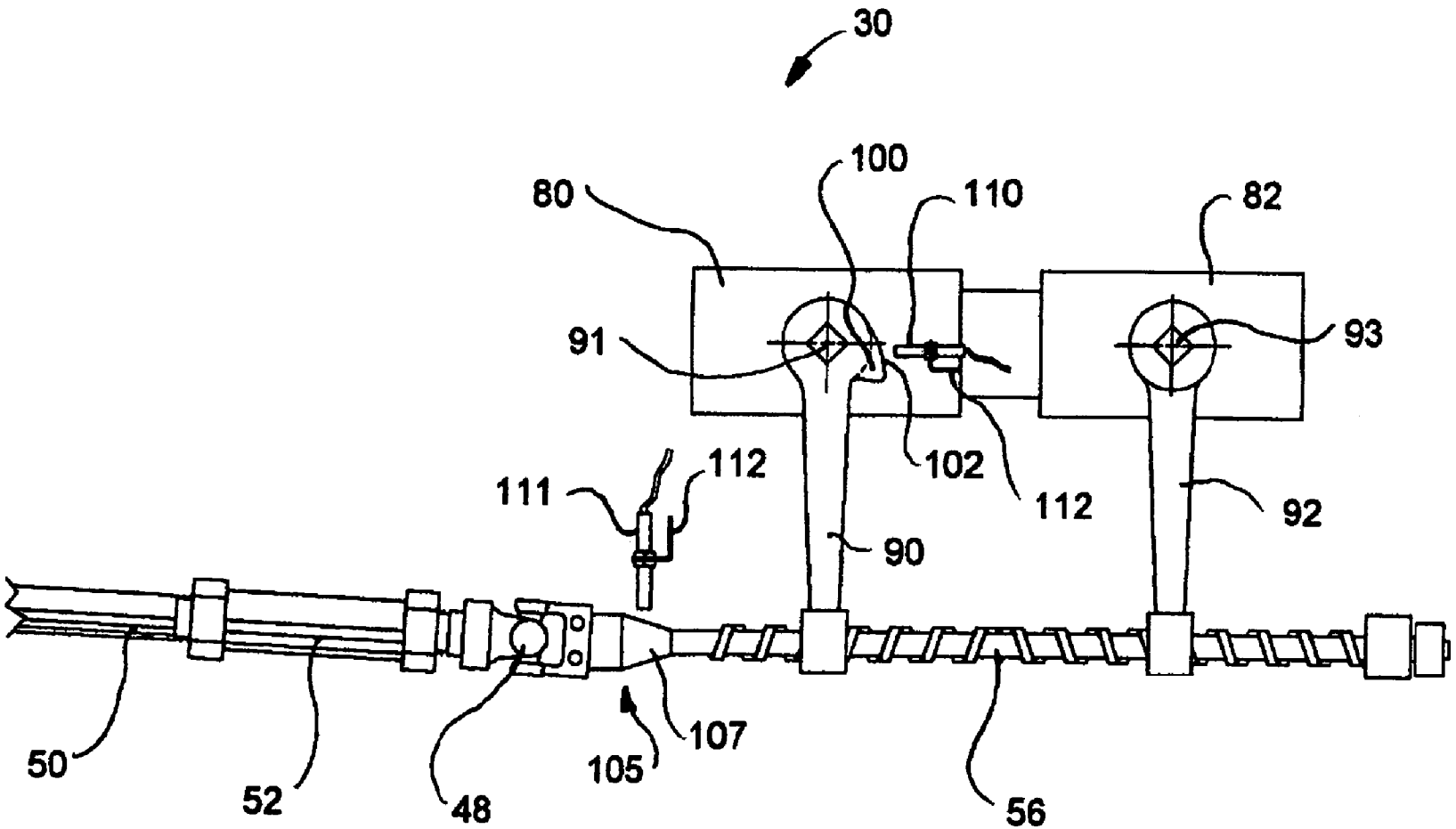
FIG. 3 is a partial side view of the directional control system showing a first alternative embodiment of the present invention.

FIG. 3 shows a portion of the directional control system of FIG. 2 showing an alternative embodiment of the present invention. In this embodiment, sensor 110 remains located proximate to pintle arm 90 where it can monitor the rotational position of the pintle arm by monitoring the separation between the sensor and the surface 102 of target structure 100. Sensor 111 is relocated to monitor the fore-aft position of control member 56 using the surface 107 of target structure 105. In this embodiment, target surface 102 and target surface 107 present similar profile changes to the sensors when moved except that surface 107 must extend around the circumference of member 56 to provide sensor target regardless of the rotational position of member 56. Additional details are provided below in relation to FIGS. 4 and 5.

Figure 4:
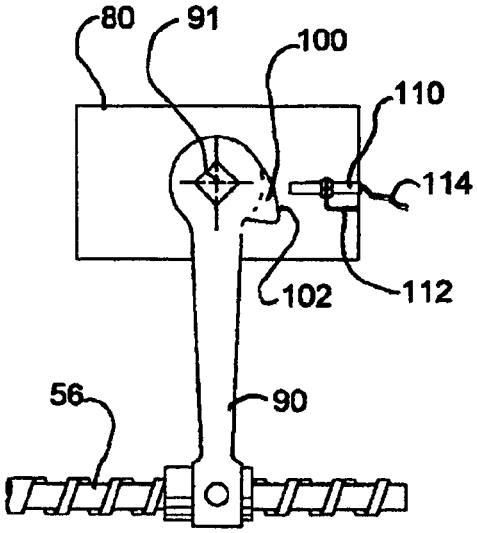
FIG. 4 is a partial view of a pintle arm, as seen in FIG. 3, of the vehicle directional control system showing a larger view of the first alternative embodiment.
Figure 7:
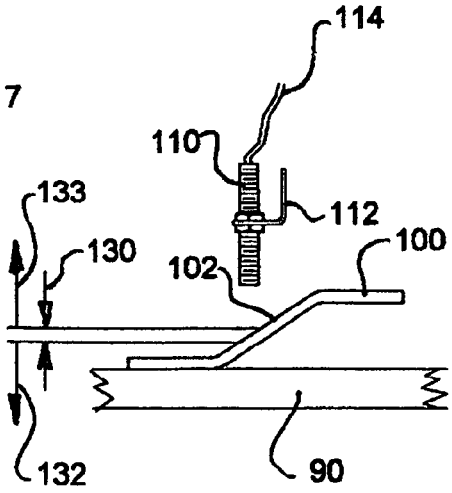
FIG. 7 is a side view of the instant invention of FIG. 6, taken along line 7-7 showing the relationship between the sensor and the target structure.

Referring now to FIG. 4, shown is a side view of pintle arm 90 as it is connected to hydraulic pump 80. Target structure 100 in this embodiment is connected to pintle arm 90 so that it pivots generally in unison with the pintle arm. Target structure 100 may be a separate structure that is connected to the pintle arm, or it may be integrally formed with the pintle arm. The surface 102 of target structure 100 is shaped so that the distance between surface 102 and pivot point 91 varies with the rotational position of the pintle arm. Sensor 110 is connected to the vehicle by a mounting structure, 112, such as an L-shaped bracket or similar device affixed to a non-moveable part of the vehicle frame as shown in FIG. 7, and positioned generally perpendicular to pivot axis 91 of the pintle arm in a manner to detect the separation between sensor 110 and target surface 102. Sensor 110 may be a proximity detector, hall-effect sensor, echo-kill sensor, or other similar device capable of providing output variations dependent upon distance between the sensor and the target. The target structure, as shown, is integral to the pintle arm structure. It is envisioned that a separate target structure can be connected to an existing pintle arm design to accomplish the same function for field retrofit.

Figure 5:
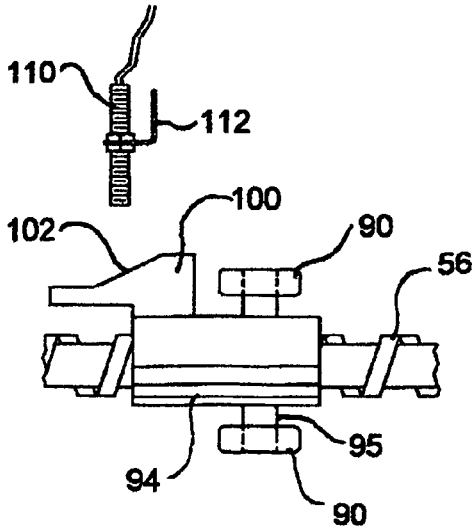
FIG. 5 is a partial view of a pintle arm, viewed from below, showing the preferred embodiment of the present invention.

FIG. 5 is a view from below the pintle arm showing drive sleeve 94 connected to pintle arm 90 by pins 95 in a manner allowing the pintle arm to pivot while member 56 remains in generally the same planar position. In this preferred embodiment, target structure 100 is connected to drive sleeve 94 so that it moves forward and rearward as the pintle arm pivots. The surface 102 of target structure 100 is shaped so that the distance between surface 102 and sensor 110 varies with forward/rearward position of the drive sleeve and thus the rotational position of the pintle arm. Target structure 100 may be a separate structure that is connected to the pintle arm, or it may be integrally formed with the pintle arm for manufacturing simplicity. Sensor 110 is connected to the vehicle by a mounting structure, 112, similar to that described in FIG. 4. In this preferred embodiment, sensor 110 is oriented generally parallel to pivot axis 91 so that the slight vertical movement of member 56 resulting from its moving through an arc as the pintle arm pivots is not detected by sensor 110.

Figure 6:
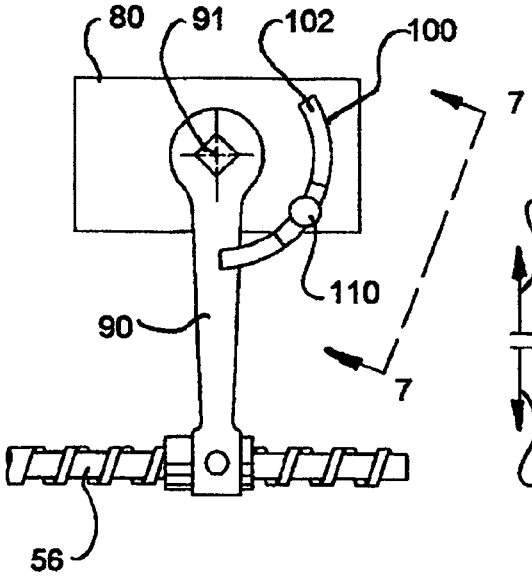
FIG. 6 is a partial view of a pintle arm of the vehicle directional control system showing a second alternate embodiment.

FIG. 6 shows a second alternative embodiment of target structure 100 in which a separate structure is connected to a pintle arm 90 as would be used to retrofit an already-existing vehicle. Target structure 100 pivots generally in unison with the pintle arm in a generally radial plane normal to the pivot axis. Sensor 110 is connected to the vehicle by a mounting structure 112 and positioned generally parallel to the pivot axis of the pintle arm in a manner to detect the distance between sensor 110 and surface 102 of the target structure. The target structure surface 102 is shaped in a way that causes the separation between the surface 102 and the sensor 110 to vary as the pintle arm is rotated. The variations in separation cause variations in the sensor output signal which correlate to the rotational position of the pintle arm. Though shown as a separate structure in FIG. 6, target structure 100 may also be formed integrally with the pintle arm thereby reducing manufacturing complexity.

FIG. 7 is a side view of FIG. 6, taken along line 7-7, showing the relationship between sensor 110 and target structure 100. Target structure 100 is positioned as it might be when the pintle arm is in the neutral position. In this position, the separation between the sensor and the target structure surface would be in neutral range 130 thereby causing the sensor to produce a neutral output signal. Pintle arm rotation causes the target structure to move relative to the sensor thereby resulting in the separation being outside the neutral position, either in the range shown as 132 or 133 dependent upon the direction of rotation, and resulting in an output signal value outside the neutral output signal, again either higher or lower dependent upon the direction of rotation. A similar relationship between the sensor and target structure occurs when the sensor monitors fore-aft position of control member 56.

Figure 8:
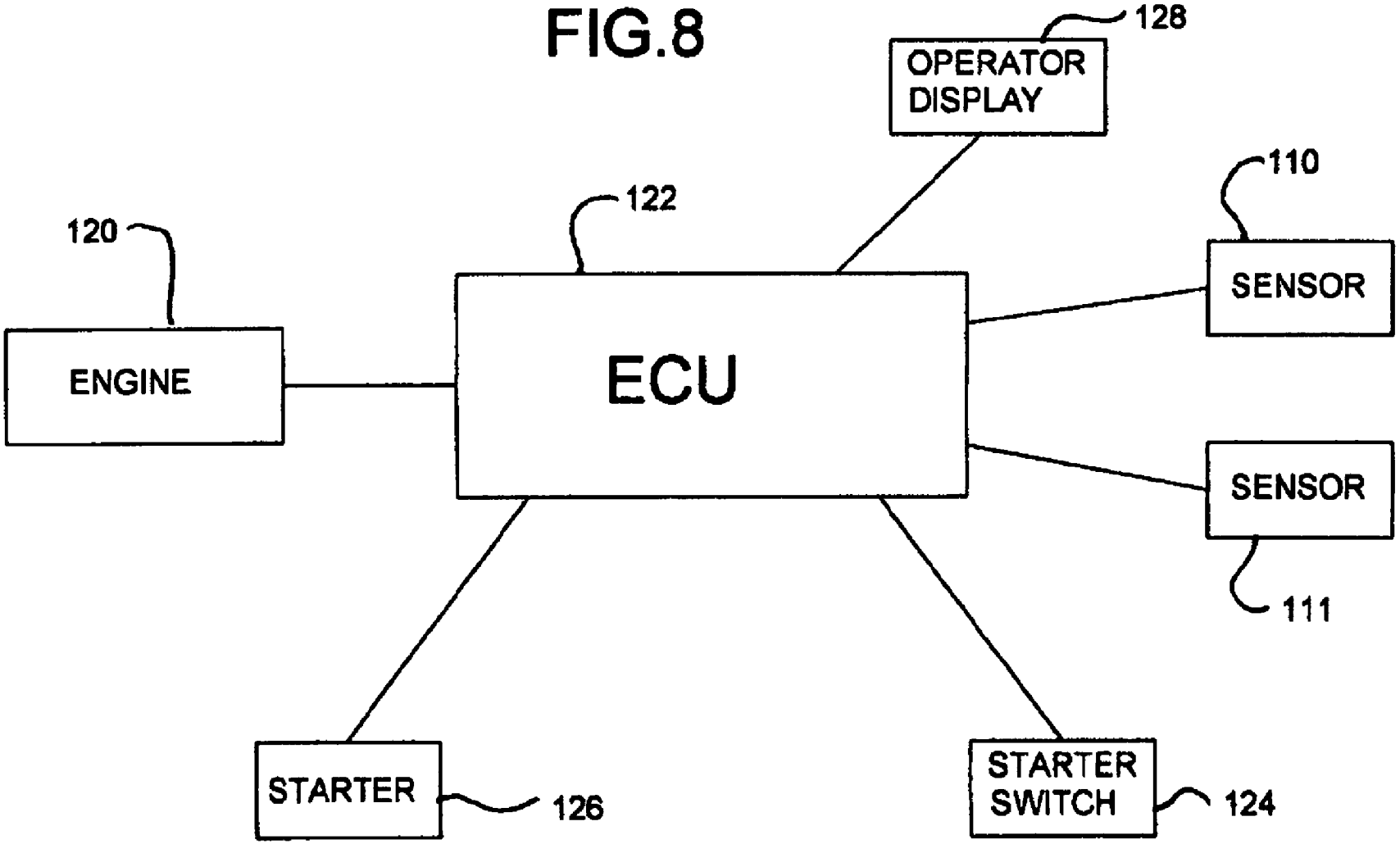
FIG. 8 is a diagrammatic representation of the neutral start system of the instant invention.

FIG. 8 is a diagrammatic representation of the neutral start system, and shows a pair of sensors 110, 111, engine 120, electronic control unit (ECU) 122, starter switch 124, starter 126, and an in-cab display 128. The ECU can take several forms, such as, for example, a programmable processor. The basic function of the neutral start interlock is accomplished broadly by linking sensors 110,111 to the pintle arms of the hydrostatic pumps and establishing a neutral signal for each. Alternatively, a first sensor may monitor one of the pintle arms and the second sensor may monitor the fore-aft position of the forward-neutral-reverse position of control member 56. The neutral signal values are fed to the memory of an ECU. When the engine starting procedure is initiated by a starter switch 124, for instance, the software in the ECU compares the stored values with the then present (in time) output signal values from sensors 110, 111. The ECU software either accepts the values and allows the engine to be started by starter 126, or it rejects the values and directs instructions to in-cab display 128 to reposition the sensors to reach neutral, such as, for example, "turn steering wheel to the right", or the like. The terms "accepts" and "rejects" as used herein means that the current output signal values are compared with stored values, and if the difference is within a proscribed limit, the starter circuit is enabled. Since there is always some tolerance in mechanical structures and mechanisms, the signal value that permits the starter circuit to be energized is usually within at least a small range of values. Generally, however, the difference in signal values is understood to be zero. It is also possible to measure only the neutral signal at one of the pintle arms and the forward-neutral-reverse shift control. It is also possible to measure only the neutral signal at one of the pintle arms or the forward-neutral-reverse shift control; however, monitoring only one of these two components is not as effective or complete as measuring both, and thus is not the preferred embodiment.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the inventions.

Having thus described the invention, what is claimed is:

1. A neutral sensing apparatus for a vehicle, the vehicle having a longitudinal axis extending between a front and an opposing rear end, at least two drive wheels supporting a main frame, an operator's platform, including a steering wheel, supported on said main frame, an engine and hydrostatic drive system supported by said main frame to supply motive power to said drive wheels, said drive system including first and second hydrostatic pumps, one for driving each wheel of said at least two drive wheels, each said pump having a depending pintle arm selectively and continuously pivotable between forward, neutral and reverse positions selectively proscribed by an input from a vehicle operator, said pintle arms in generally the same vertical plane, said steering wheel supported on said operator's platform and rotatable in first and second opposing directions, said steering wheel having a neutral alignment wherein said vehicle travels generally parallel with said longitudinal axis, a rotational motion transfer mechanism having first and second opposing ends, said first end of said motion transfer mechanism connected to said steering wheel such that rotation of said steering wheel causes a generally equal amount of rotation of said second end of said motion transfer mechanism, said second end of said motion transfer mechanism connected to said pintle arms such that rotation of said second end in said first direction pivots said pintle arms apart, and rotation in said second direction rotates said pintle arms together; a neutral start interlock interacting with said engine and said hydrostatic drive system to prevent, when activated, the starting of said engine when said pintle arms are in said forward or reverse positions, said neutral start interlock further comprising:

at least one target structure connected to at least one pintle arm and configured to pivot in unison with said at least one pintle arm, said at least one target structure further comprising a target surface having a contour and a separation distance to a fixed position normal to said at least one target surface, the contour of the target surface shaped so that the separation distance corresponds to the position of said at least one pintle arm and so that the separation distance remains detectable by a sensor as the pintle arm is rotated;

a mounting structure adjacent to said target structure, said mounting structure supported on said frame;

a the sensor supported on said mounting structure, said sensor configured to detect said separation distance to said target surface without contacting said target surface; the sensor is configured to emit an output signal having a value dependent upon the position of said at least one pintle arm, said output signal directed to said interlock system;

an ECU and a visual display unit, said ECU and an electronic memory containing a first stored value representing said neutral position of said at least one pintle arm, said ECU further including software to compare a first present output signal value from said sensor with said first stored value and selectively generate a message to said visual display depending upon the difference between said first stored value and said first present signal value;

a starter circuit for said engine, said starter circuit electronically connected to said ECU, and said software in said ECU configured to permit said starter circuit if the difference between said first stored value and said first present signal value is within a first predetermined range.

2. The apparatus of claim 1, wherein said first predetermined range includes zero.

3. The apparatus of claim 1, wherein said target surface contour is configured so that the contour has multiple portions, each portion having a unique separation distance between said target surface and said sensor generally corresponding with said pivotable position of said pintle arm, wherein variations in said separation distance cause variations in said output signal generally corresponding to said pivotable position.

4. The apparatus of claim 3, wherein said target surface contour comprises a first portion, a second portion, and a third portion, said second portion configured such that said first present output signal is greater than said first stored value or range correlating to a neutral pintle arm position;

said third portion configured such that said first present output signal value to be less than said first stored value, and said first portion causing said first present output signal value to be substantially equal to said first stored value or range; wherein the second and third portion and their associated first present signal value are configured to correspond with forward and reverse positions of the pintle arm with respect to the neutral position.

5. The apparatus of claim 1, wherein said target surface is integral to said pintle arm.

6. The apparatus of claim 4, wherein said sensor is a proximity detector.

7. The apparatus of claim 4, wherein said sensor is a hall-effect sensor.

8. In an agricultural windrower having a longitudinal axis extending between a front and an opposing rear end, at least two drive wheels supporting a main frame, an operator's platform, including a steering wheel, supported on said main frame, an engine and hydrostatic drive system supported by said main frame to supply motive power to said drive wheels, said drive system including first and second hydrostatic pumps, one for driving each wheel of said at least two drive wheels, each said pump having a depending pintle arm selectively and continuously pivotable between forward, neutral and reverse positions selectively proscribed by an input from, a vehicle operator, said pintle arms in generally the same vertical plane, said steering wheel supported on said operator's platform and rotatable in first and second opposing directions, said steering wheel having a neutral alignment wherein said vehicle travels generally parallel with said longitudinal axis, a rotational motion transfer mechanism having first and second opposing ends, said first end of said motion transfer mechanism connected to said steering wheel such that rotation of said steering wheel causes a generally equal amount of rotation of said second end of said motion transfer mechanism, said second end of said motion transfer mechanism connected to said pintle arms such that rotation of said second end in said first direction pivots said pintle arms apart, and rotation in said second direction rotates said pintle arms together; the improvement comprising:

a neutral start interlock interacting with said engine and said hydrostatic drive system to prevent, when activated, the starting of said engine when said pintle arms are in said forward or reverse positions, said neutral start interlock further comprising:

at least one target structure connected to at least one pintle arm and configured to pivot in unison with said at least one pintle arm, said at least one target structure further comprising a target surface having a contour; and a separation distance to a fixed position normal to said at least one target surface; the contour of the target surface shaped so that the separation distance corresponds with to the position of said at least one pintle arm and so that the separation distance remains detectable by a sensor as the pintle arm is rotated;

a mounting structure adjacent to said target structure, said mounting structure supported on said frame;

the sensor supported on said mounting structure, said sensor configured to detect said separation distance to said target surface without contacting said target surface; the sensor is configured to emit an output signal having a value dependent upon the position of said at least one pintle arm, said output signal directed to said interlock system;

an ECU and a visual display unit, said ECU having an electronic memory containing a first stored value representing said neutral position of said at least one pintle arm, said ECU further including software to compare a first present output signal value from said sensor with said first stored value and selectively generate a message to said visual display depending upon the difference between said first stored value and said first present signal value;

a starter circuit for said engine, said starter circuit electronically connected to said ECU, and said software in said ECU configured to permit said starter circuit if the difference between said first stored value and said first present signal value is within a first predetermined range.

9. The improvement of claim 8, wherein said first predetermined range includes zero.

10. The improvement of claim 8, wherein said target surface contour is configured to have multiple separation distances between said target surface and said sensor generally corresponding with said pivotable position of said pintle arm, the sensor configured to emit multiple output signal corresponding to the multiple separation distances created by changes in pivotable position of the arm.

* * * * *